US006050118A

United States Patent [19]

Kito

[11] Patent Number: 6,050,118

[45] Date of Patent: Apr. 18, 2000

[54] CARD KEY PROVIDED WITH TRANSMITTER ELEMENT

[75] Inventor: Shozo Kito, Niwa-gun, Japan

[73] Assignee: Kabushiki Kaisha Tokai-Rika-Denki-Seisakusho, Niwa-gun, Japan

[21] Appl. No.: 08/983,552

[22] PCT Filed: May 19, 1995

[86] PCT No.: PCT/JP95/00969

§ 371 Date: Nov. 25, 1996

§ 102(e) Date: Nov. 25, 1996

[87] PCT Pub. No.: WO95/33114

PCT Pub. Date: Dec. 7, 1995

[30] Foreign Application Priority Data

May 27, 1994 [JP] Japan ..... 6-115728

[51] Int. Cl.[7] ..... A44B 15/00

[52] U.S. Cl. ..... 70/456 R; 70/408; 70/395; 340/825.34; 307/10.6

[58] Field of Search ..... 70/456 R, 457, 70/458, 408, 413, 278.1, 278.2, 395; 340/825.31, 825.34; 307/10.5, 10.6

[56] References Cited

U.S. PATENT DOCUMENTS

| | | | |
|---|---|---|---|
| 4,524,594 | 6/1985 | Bascou . | |
| 4,726,205 | 2/1988 | Allerdist et al. | 70/408 |
| 4,936,123 | 6/1990 | Matsuda | 70/456 R |
| 4,941,569 | 7/1990 | Lindmayer et al. . | |
| 4,959,983 | 10/1990 | Hsu | 70/408 |
| 5,046,343 | 9/1991 | Miwa | 70/408 |
| 5,307,658 | 5/1994 | Kokubu et al. | 70/276 |
| 5,433,096 | 7/1995 | Janssen et al. | 70/413 |
| 5,513,507 | 5/1996 | Merchel | 70/413 |
| 5,561,331 | 10/1996 | Suyama et al. | 70/456 R |
| 5,632,168 | 5/1997 | Yano | 70/408 |
| 5,679,984 | 10/1997 | Talbot et al. | 70/256 |
| 5,775,148 | 7/1998 | Layton et al. | 70/408 |
| 5,836,187 | 11/1998 | Janssen et al. | 70/408 |

FOREIGN PATENT DOCUMENTS

| | | |
|---|---|---|
| 62-72213 U | 5/1987 | Japan . |
| 63-102862 U | 7/1988 | Japan . |

*Primary Examiner*—Darnell M. Boucher
*Attorney, Agent, or Firm*—Oliff & Berridge, PLC

[57] ABSTRACT

A key body (14) is inserted into a recess (16) to be held on a card key support (12). When a spare key (10) is used, the key body (14) is removed from the recess (16) and inserted into the recess (26). Accordingly, a lock insertion portion (14B) protrudes from the card key support (12) for manipulation of the key. A transmitter element (18) is mounted to the card key support (12) near a base portion (14A) of the key body (14) which is mounted to the recess (26) so that an ID signal is transmitted from the transmitter element (18) in the direction of the key cylinder in the same manner as in an original key. An operating condition of an engine is thereby maintained.

24 Claims, 7 Drawing Sheets

CARD KEY PROVIDED WITH TRANSMITTER ELEMENT

FIELD OF THE ART

The present invention relates to a card key which is formed in a card shape and in which a transmitter element is built inside.

BACKGROUND OF THE ART

Conventionally, in a general relationship between a key and a lock(latch), mechanical irregularities formed at an insertion portion of a key body or magnetic force of an embedded magnet drive(s) a plurality of pins placed at an inner cylinder within the lock so as to move the pins extending over a boundary surface between the inner cylinder and a fixed outer cylinder. The inner cylinder is rotatable within the outer cylinder so as to be unlatched.

However, in such a mechanical combination of a key and a lock, unlocking is possible if the configuration of a duplicated key is the same as that of an original key, and further, it is difficult to protect such a mechanical lock from subversive activities.

Regarding in particular an engine key of a vehicle. even if the engine key is not used, an engine starter can be operated by directly connecting electrical wires. Consequently, a complete key function cannot be achieved by the general combination of a key and a lock.

Thus, in addition to the key insertion portion equipped with mechanical irregularities and a magnetic force generating portion, a key in which a transmitter element is built is proposed. As an example, the transmitter element can start or continue to operate a vehicle engine only if a receiver element provided at the vehicle receives a specific signal. In this way, movement of the vehicle can be prevented due to the direct connections of the electrical wires or the mechanical destruction.

In general, besides an original key, a so-called card key is used as a key for an automobile. The card key is a thin and light plate-shaped spare key which is made of a synthetic resin or the like and is produced so as to be ready for a case in which the original key is lost. However, unless the transmitter element is provided at the card key serving as a spare key, when the original key is lost, the card key cannot start the vehicle engine.

DISCLOSURE OF THE INVENTION

With the aforementioned in view, an object of the present invention is to provide a transmitter element at a card key so as to obtain, in case of using a spare key function, a card key provided with a transmitter element which can have the same transmitting function as an ordinary key.

The present invention is a card key provided with a transmitter element, comprising: a plate-shaped card key support; a plate-shaped key body which is held at said card key support and which includes a lock insertion portion; and a transmitter element which is mounted to said card key support so as to generate induced electromotive force.

In accordance with the present invention, the plate-shaped key body, which includes the lock insertion portion, and the transmitter element are held at the plate-shaped card key support. As an aspect of holding the transmitter element at the card key support, a recess is provided at the card key support so that the key body can be inserted into and held at the recess. When the key body is inserted and held in this way, the transmitter element is inserted into and held at a holding recess provided at the card key support. As a result, mounting of the transmitter element is reliable, and even if external force acts on the card key support, a large amount of stress does not act on the transmitter element. Within the holding recess, the transmitter element can be held by the elasticity of the card key support or by the adhesive agent. After the transmitter element is inserted, a cover member may be mounted to the recess so as to prevent removal of the transmitter element and to protect the transmitter element from the external force. In a case in which the transmitter element is heat resistant, the transmitter element may be directly filled in the card key support by insert molding or the like.

Further, a card key provided with a transmitter element, comprising: a plate-shaped card key support; an accommodating recess which is formed at said card key support; a plate-shaped key body which is accommodated within said accommodating recess so as to be removable and which includes a base portion and a lock insertion portion; a supporting member which is formed at said card key support, said supporting member supporting the base portion of said key body, which has been removed from said accommodating recess, such that the lock insertion portion projects from said card key support; a holding recess which is formed near said supporting member of said card key support; and a transmitter element which is inserted into and held at said holding recess so as to generate induced electromotive force.

In accordance with this structure, when the base portion of the plate-shaped key body is supported by the supporting member of the card key support and the lock insertion portion protrudes from the card key support so as to operate the spare key, the transmitter element is inserted into and held at the holding recess which is formed near the supporting member of the key body. Accordingly, mounting of the transmitter element is reliable and the transmitting function at the time of operating the key can be reliably achieved.

Due to the above-described structure, in accordance with the card key provided with the transmitter element relating to the present invention, if the card key is used as a spare key, the transmitter element can send a signal to the lock similarly to the case in which the original key is used. Accordingly, the card key can start or continue to operate the vehicle engine.

DETAILED DESCRIPTION OF PREFERRED EMBODIMENTS

A spare key 10 relating to a first embodiment of the present invention is described with reference to FIGS. 1 through 7. In this spare key 10, a key body 14 which is made of a metal is held at a rectangular plate-shaped card key support 12 which is formed of a synthetic resin.

Figure 7:
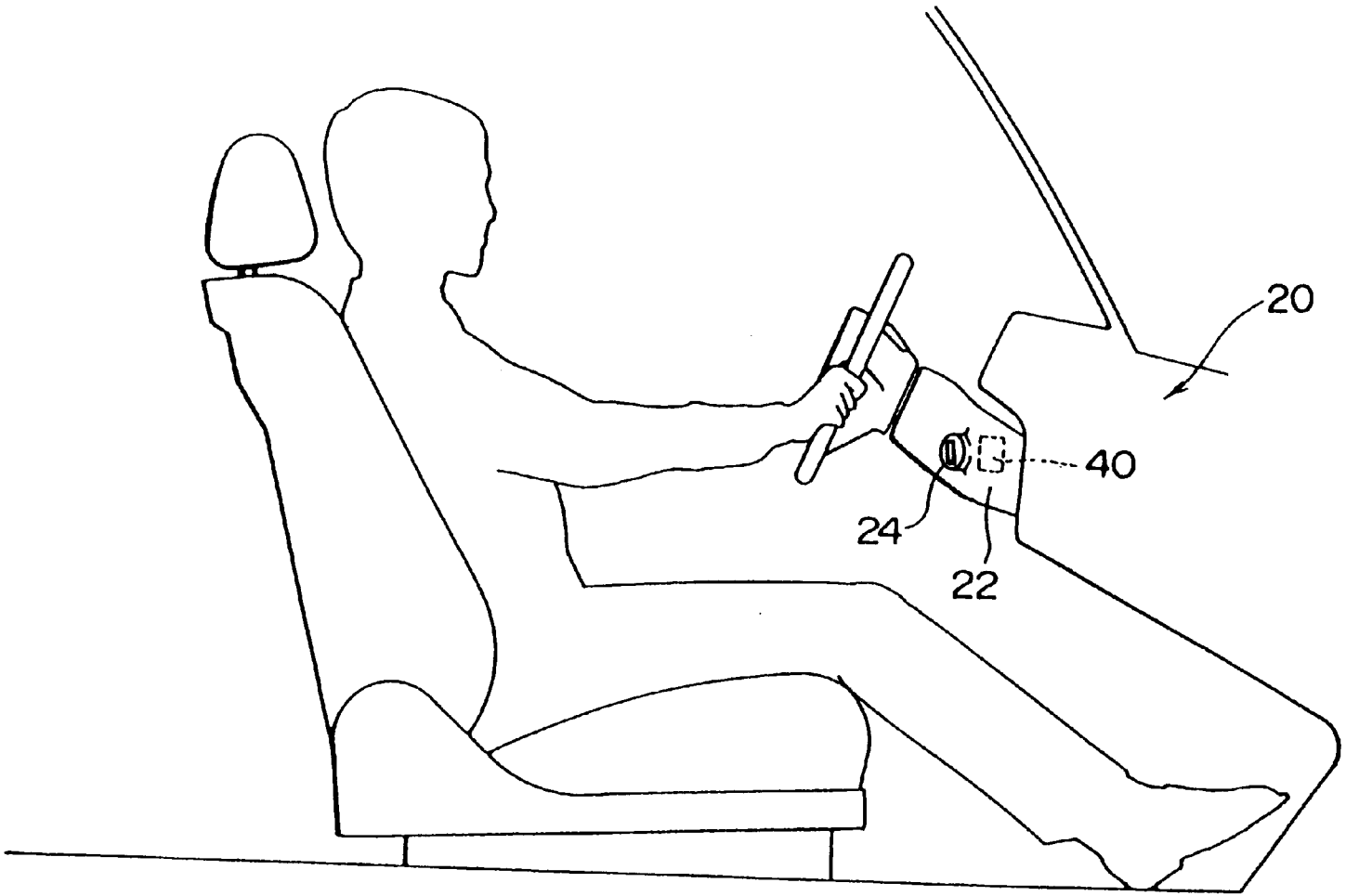
FIG. 7 is a side view of a vehicle illustrating a state in which the control module is placed therein.

A recess 16 is formed at a substantially central portion of the card key support 12, and the key body 14 is inserted into and held at the recess 16. The inner dimensions of the recess 16 are substantially the same as the outer dimensions of the key body 14, such that the key body 14 is tightly accommodated in the recess 16 and is not easily removed therefrom. It is therefore preferable that the inner dimensions of the recess 16 are slightly smaller than the outer dimensions of the key body 14. In the key body 14, an insertion portion 14B projects from a base portion 14A. Mechanical irregularities resembling those of an original key are formed at the insertion portion 14B by poor manufacturing. As illustrated in FIG. 7, the insertion portion 14B is used for inserting into a key cylinder 24 which is provided at a steering column 22 of a vehicle 20. At the time of normal driving of the vehicle, an original key must be inserted into the key cylinder 24 so as to effect the normal driving of the vehicle.

Figure 5:
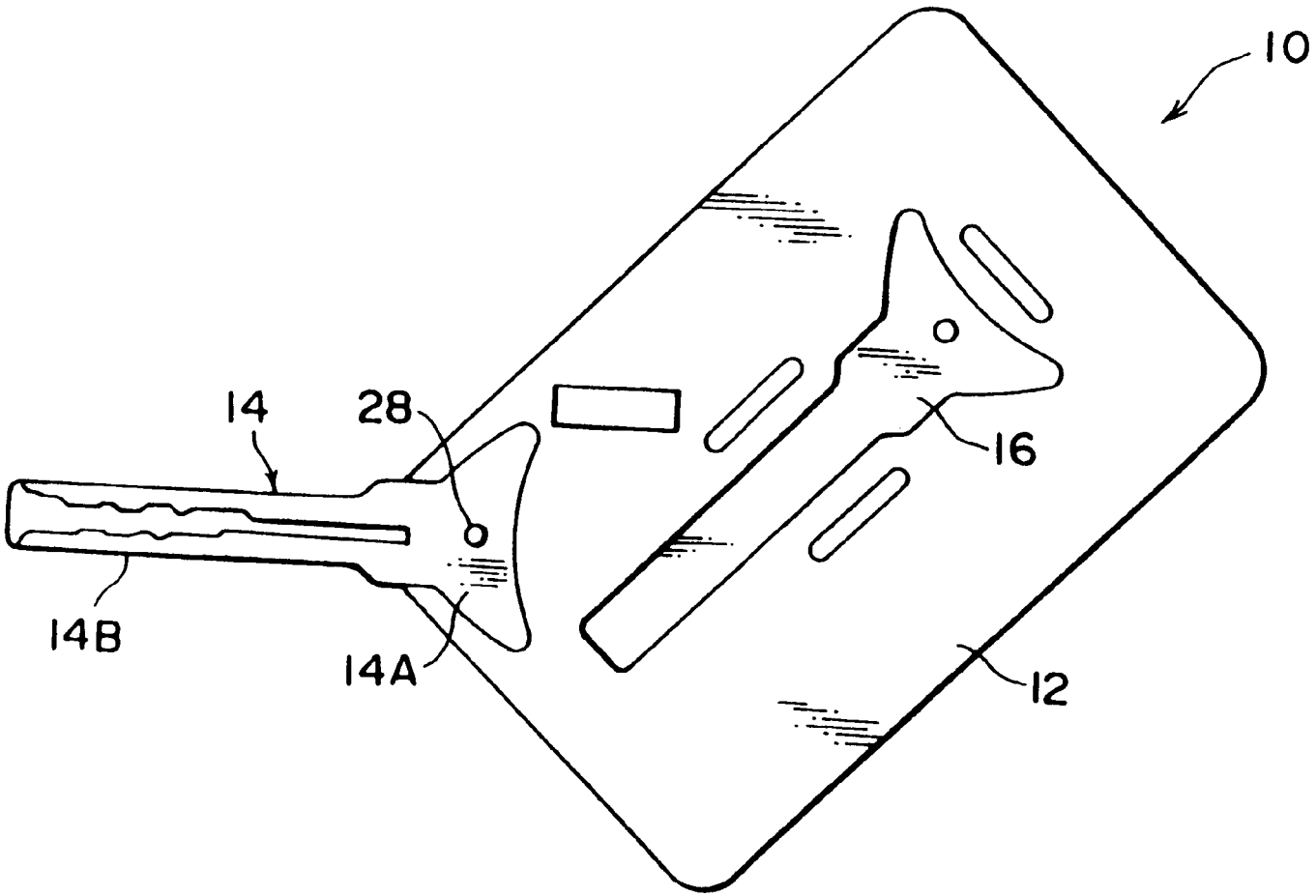
FIG. 5 is an elevational view showing a state in which the card key of FIG. 1 is used.

A recess 26 which serves as a supporting member and accommodates the base portion 14A of the key body 14 is provided near a corner portion of the card key support 12. The inner dimensions of the recess 26 are the same as the outer dimensions of the key body base portion 14A so that the base portion 14A can be fixedly held at the recess 26. As illustrated in FIG. 5, when the key body base portion 14A is inserted into the recess 26, the insertion portion 14B projects outwardly from the corner portion of the card key support 12, such that a user can operate a key which serves as a spare key by using the card key support 12 as a key knob.

A projection 28, which corresponds to a circular hole 14C formed at the base portion 14A of the key body 14, projects from the recess 26. The projection 28 is tightly inserted through the circular hole 14C of the key body base portion 14A which is inserted Into the recess 26, such that the key body base portion 14A can be reliably supported in the recess 26.

Figure 1:
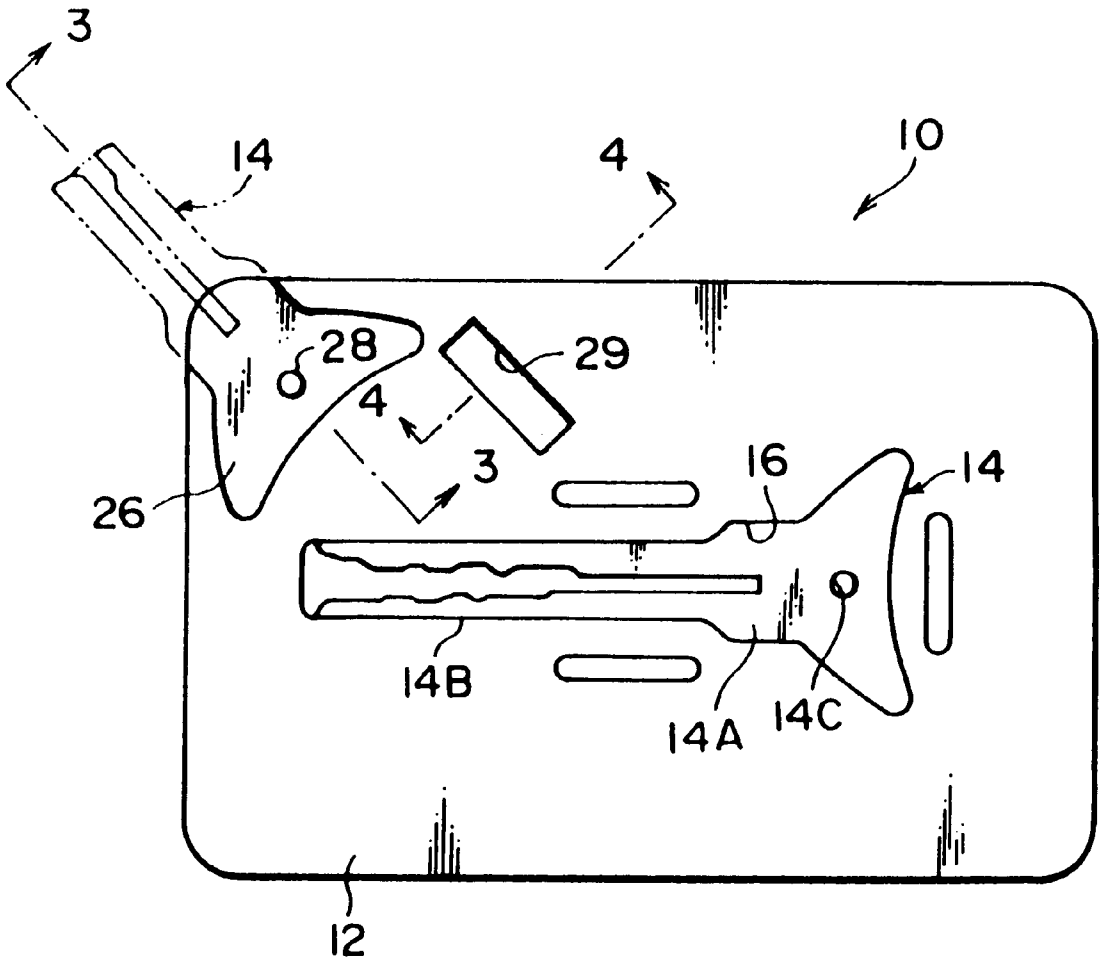
FIG. 1 is an elevational view of a card key illustrating a first embodiment of the present invention.
Figure 2:
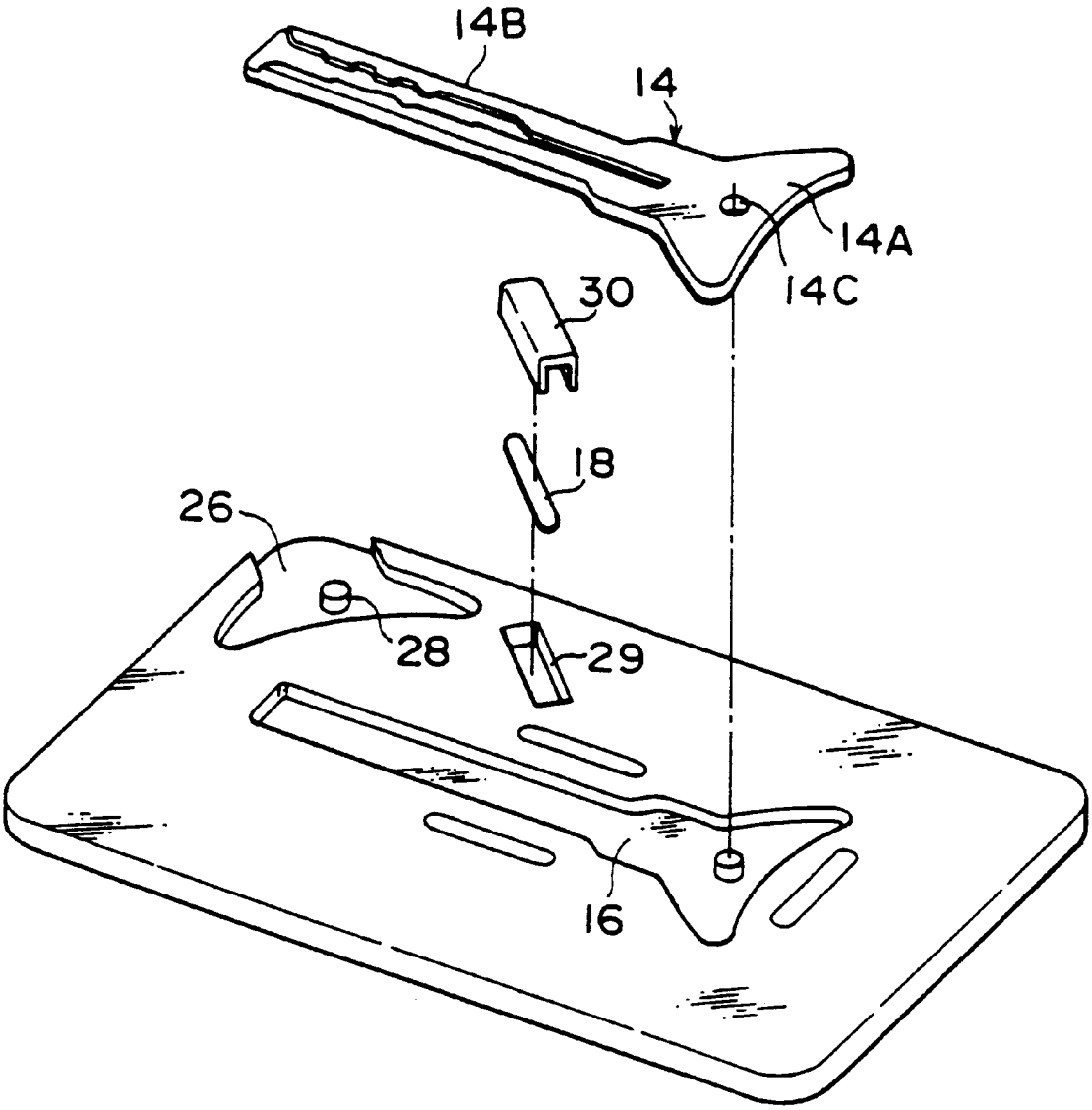
FIG. 2 is a exploded perspective view of FIG. 1.
Figure 3:
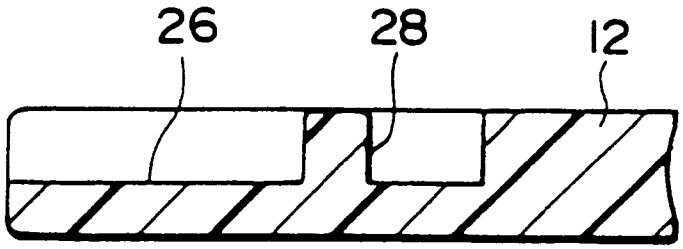
FIG. 3 is a cross-sectional view, taken along a line 3—3 of FIG. 1.
Figure 4:
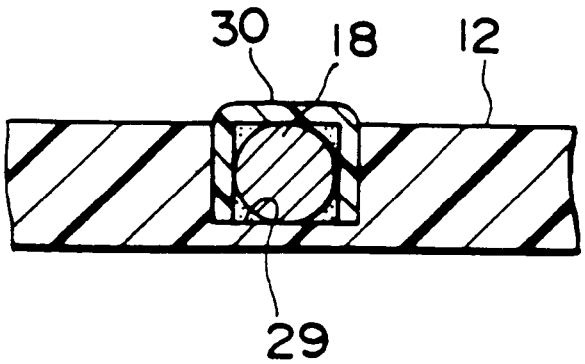
FIG. 4 is a cross-sectional view, taken along a line 4—4 of FIG. 1.

As shown in FIGS. 1 and 2, a holding recess 29 is formed in a vicinity of the recess 26, and the longitudinal direction of the holding recess 29 is substantially parallel to the longitudinal direction of the key body 14 which is mounted to the recess 26. As illustrated in FIG. 4, a transmitter element 18 is inserted into the holding recess 29, and by fitting a cover member 30 whose cross-sectional configuration is substantially U-shaped into the holding recess 29, the transmitter element 18 is held at the card key support 12. In order to hold the transmitter element 18 reliably, the transmitter element 18 or the cover member 30 may be mounted to the card key support 12 by using an adhesive agent. Even if the adhesive agent is not used, the cover member 30 can be mounted by press fitting into the holding recess 29 or by using snap fitter or the like. Moreover, in a case in which the transmitter element 18 is heat resistant, when the card key support 12 is formed by a synthetic resin, the transmitter element 18 can be filled integrally into the card key support 12. Because the transmitter element 18 is accommodated within the holding recess 29 of the card key support 12, the transmitter element 18 does not project toward the surface of the card key support 12 and can be protected from the external force.

As illustrated in FIG. 7, a control module 40 is mounted near the steering column 22. The control module 40 is preferably provided within a cover of the steering column 22 so that the control module 40 is not visible from outside.

Figure 6:
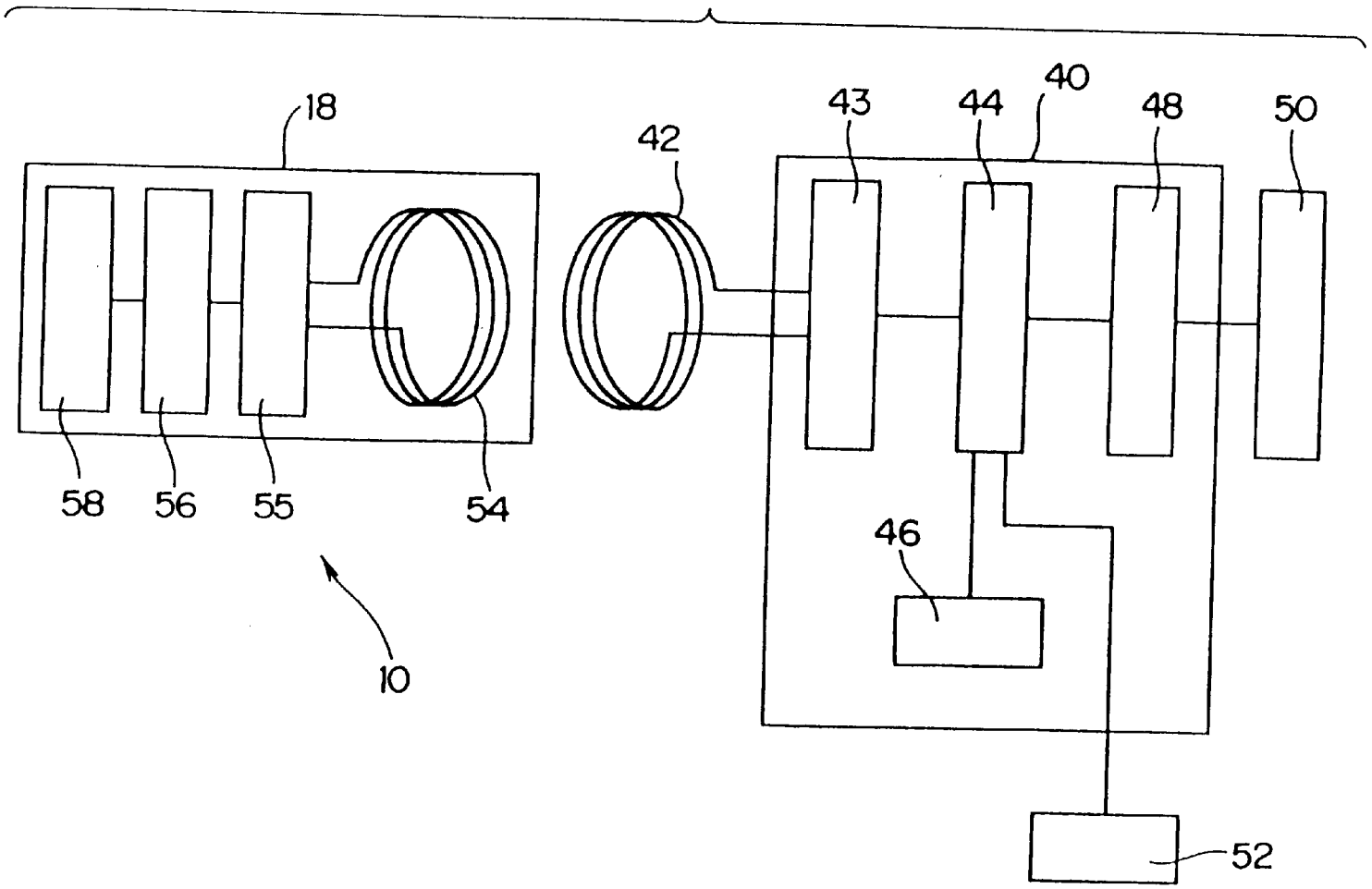
FIG. 6 is a circuit diagram illustrating a transmitter element and a control module.

As shown in FIG. 6, in the control module 40, a transmit-receive coil 42, a transmit-receive circuit 43, a control circuit 44 and a memory 46 are connected, and the control circuit 44 is connected to a vehicle control circuit 50 via an interface circuit 48. As a result, in the control module 40, when a vehicle engine is started or when a receiving signal is generated at the transmit-receive coil 42, the control circuit 44 sends an actuating signal from the transmit-receive coil 42 to the transmitter element 18 of the key 10 via the transmit-receive circuit 43, and the transmit-receive coil 42 receives an ID signal from the transmitter element 18 of the key 10. The control circuit 44 determines whether the ID signal is appropriate. Moreover, a registration code writing device 52 is connected to the control circuit 44 so that ID numbers can be written into the memory 46.

On the other hand, a transmit-receive coil 54, a transmit-receive circuit 55, a control circuit 56 and a memory 58 are disposed and connected in the transmitter element 18. Accordingly, in the transmitter element 18, the transmit-receive coil 54 generates electromotive force due to an electric current generated at the transmit-receive coil 42, the control circuit 56 is operated via the transmit-receive circuit 55, and an ID number stored in the memory 58 can be transmitted from the transmit-receive coil 54 to the transmit-receive coil 42. The transmit-receive coil 42 which has received the ID number sends the received signal to the control circuit 44 via the transmit-receive circuit 43, and thereby, the control circuit 44 checks whether the ID number stored in the memory 46 corresponds to the received ID number. If the ID numbers correspond, the control circuit 44 sends a signal to the vehicle control circuit 50 via the interface circuit 48 so as to start or continue to operate the vehicle engine. In a case in which the received ID number is different from the ID number stored in the memory 46 or in a case in which the ID number is not received, a different signal is sent to the vehicle control circuit 50 so as to prevent starting or stop operating the engine.

The transmit-receive circuit 55, the control circuit 56 and the memory 58 within the transmitter element 18 are formed by one integrated circuit (IC). As an example, the size of the outer configuration of the transmitter element 18 is 1 mm in diameter and 10 mm in length.

As shown in FIG. 1, the spare key 10 of the present embodiment structured as above is kept in a state in which the key body 14 is accommodated within the recess 16.

Normally, the original key is inserted into the key cylinder 24 at the steering column 22 of the vehicle and is rotated together with the inner cylinder of the key cylinder 24. Thereafter, the vehicle control circuit 50 drives a starter so as to start the vehicle engine.

When the spare key 10 is used, the key body 14 is removed from the recess 16 of the card key support 12, the key body base portion 14A is inserted into the recess 26, and the circular hole 14C is engaged with the projection 28 so as to be fixed. The engaged state is shown in FIG. 5. Accordingly, when a user holds the card key support 12 as if he/she holds a key knob and inserts the insertion portion 14B projected from the card key support 12 into the key cylinder 24, operation of the key similar to that of the original key is possible. Since the subsequent transmit-receive relationship between the control module 40 and the transmitter element 18 is the same in the case of using the original key and in the case of using the spare key 10, a description will be given of a case in which the spare key 10 is used.

The transmit-receive circuit 43 of the control module 40 receives from the vehicle control circuit 50 a signal in which the vehicle engine has started, the control circuit 44 operates the transmit-receive circuit 43 so as to send an electric current to the transmit-receive (oil 42. As a result, the transmitter element 18 of the spare key 10 which is disposed near the transmit-receive coil 42 generates electromotive force at the transmit-receive coil 54. The control circuit 56 is operated by the electromotive force and transmits the ID number stored in the memory 58 from the transmit-receive coil 54. The transmitted signal is received at the transmit-receive coil 42 and sent to the control circuit 44 via the transmit-receive circuit 43. Consequently, in a case in which the received ID number is the same as the ID number which has been stored in the memory 46 in advance, the control circuit 44 sends the signal to the vehicle control circuit 50 so that the vehicle control circuit 50 continues to run the vehicle engine. However, in a case in which the received ID number is different from the ID number stored in the memory 46 or in a case in which the ID number is not received, the control circuit 44 sends a different signal to the vehicle control circuit 50. As a result, the vehicle control circuit 50 stops running of the vehicle engine.

In the above-described embodiment, the spare key 10 sends the ID number to the control module 40 after the vehicle engine is operated. However, the ID number may be sent when the spare key 10 is inserted into the key cylinder 24. The vehicle control circuit 50 may start the engine afterwards.

Figure 8:
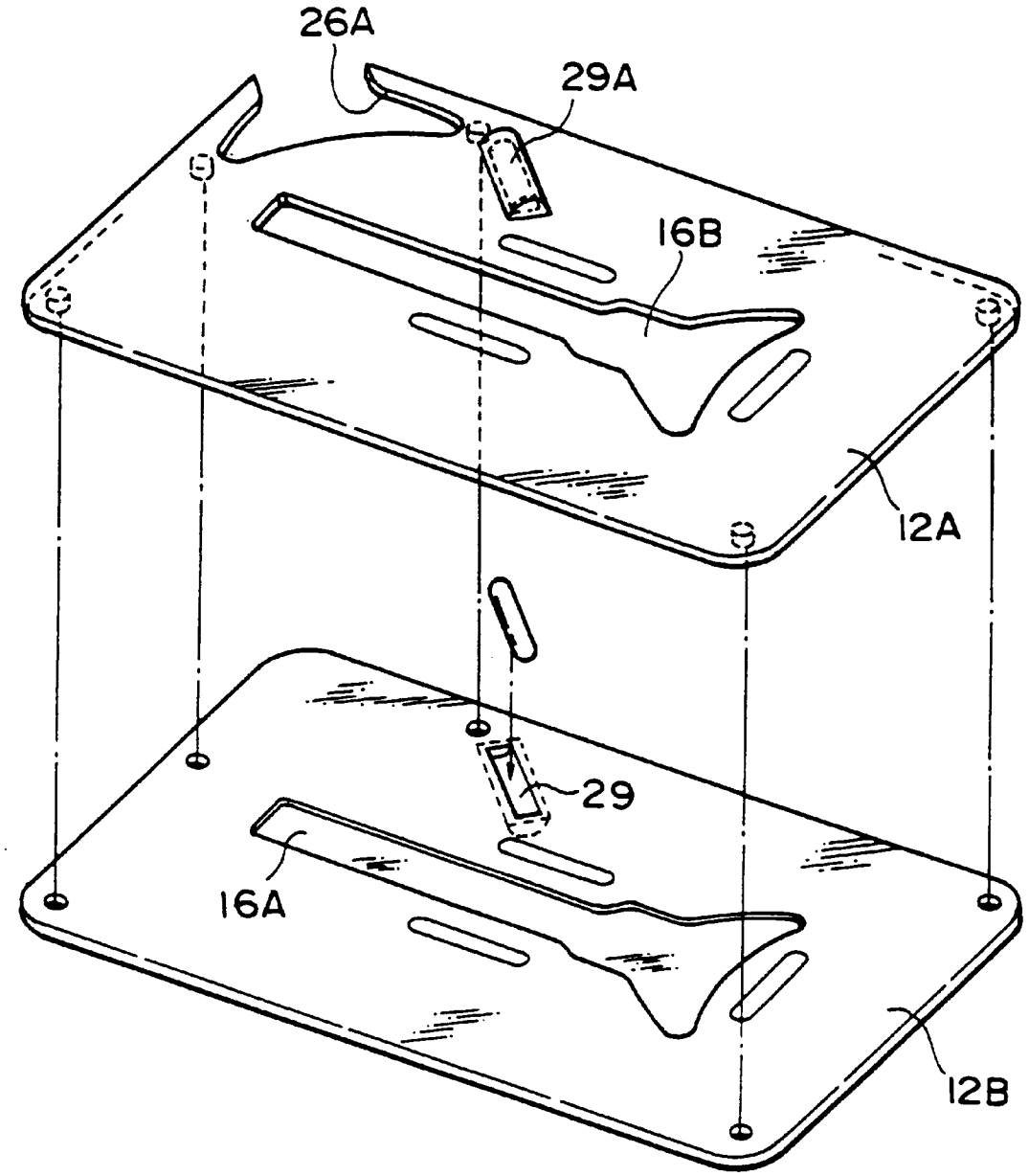
FIG. 8 is an exploded perspective view of a card key support relating to a second embodiment of the present invention.

A second embodiment of the present invention is illustrated in FIG. 8.

In the second embodiment, the card key support 12 of the first embodiment is formed by two card key supports 12A, 12B. By superposing the card key support 12A on the card key support 12B, the thickness of the superposed card key supports 12A, 12B is the same as the card key support 12 of the first embodiment. A recess 16A which corresponds to the recess 16 of the first embodiment is formed at the card key support 12B, and a holding recess 29 which receives a transmitter element 18 is formed thereat. On the other hand, a through-hole 16B which corresponds to the recess 16A and a through-hole 26A which corresponds to the recess 26 of the first embodiment are formed at the card key support 12A, and a projection 29A is formed near the through-hole 26A such that a reverse surface of the projection 29A forms a recess which corresponds to the holding recess 29.

Therefore, when the two card key supports 12A, 12B are superposed by adhesion, melt-adhesion or the like, the recess 16A and the through-hole 16B form a holding recess in the key body 14 similar to the recess 16 of the first embodiment, and the portion of the surface of the card key support 12B which corresponds to the through-hole 26A serves as the bottom surface of the through-hole 26A such that the through-hole 26A forms a recess similar to the recess 26 of the first embodiment. Further, a space for accommodating and closing the substantially cylindrical transmitter element 18 is formed between the holding recess 29 and the reverse surface of the projection 29A so as to reliably hold the transmitter element 18.

Therefore, in the second embodiment as well, when the spare key 10 is used, the key body 14 is removed from the through-hole 16B and positioned at the holding recess 29. The key is able to be used in the same manner as the key illustrated in FIG. 5 is used.

In the above embodiments, descriptions are given of a structure in which the key body 14 is removed from the card key support, and thereafter, is mounted to a different place again so that the spare key is used. However, in a case in which a portion of the key body 14 is connected to a card key support, a structure may be used in which the insertion portion 14B projects from the card key support by sliding or bending the key body 14. Moreover, it is preferable that the portion of the card key support to which the transmitter element 18 is mounted Is made of a synthetic resin or a brass so that the vicinity of the transmitter element 18 does not have adverse effects on the magnetic flux. Further, the key body 14 is not limited to a metal, and a synthetic resin may be used provided that the material has sufficient strength.

What is claimed is:

1. A card key provided with a transmitter element, comprising:

a flat card key support;

a flat key body held by said card key support and which includes a lock insertion portion; and a transmitter element mounted to said card key support, said transmitter element generating induced electromotive force.

2. A card key provided with a transmitter element, comprising:

a flat card key support;

a flat key body held by said card key support and which includes a lock insertion portion;

a holding recess formed in said card key support; and a transmitter element inserted into and held at said holding recess, said transmitter element generating induced electromotive force.

3. A card key provided with a transmitter element, comprising:

a flat card key support;

an accommodating recess formed in said card key support;

a flat key body removably accommodated within said accommodating recess, and which includes a base portion and a lock insertion portion;

a supporting member formed in said card key support, said supporting member supporting the base portion of said key body when said key body has been removed from said accommodating recess, such that the lock insertion portion projects from said card key support;

a holding recess formed near said supporting member of said card key support; and a transmitter element inserted into and held at said holding recess, said transmitter element generating induced electromotive force.

4. The card key of claim 1, wherein the transmitter element includes a transmit-receive coil that generates the electromotive force.

5. The card key of claim 1, wherein the flat key body is a vehicle ignition key, and the transmitter element transmits an ID signal used to permit a vehicle to start or remain in operation when the lock insertion portion of the key body is inserted into a vehicle ignition slot.

6. The card key of claim 1, wherein the flat key body includes a base portion, the card key further comprising a supporting member formed in the card key support, the supporting member removably supporting the base portion of the key body such that the lock insertion portion projects from the card key support.

7. The card key of claim 6, wherein the transmitter element is mounted to the card key support near the supporting member.

8. The card key of claim 6, wherein the supporting member is a recess in the card key support.

9. The card key of claim 8, wherein the recess is located at a corner of the card key support.

10. The card key of claim 6, wherein the supporting member includes a holding member that engages a corresponding holding member of the flat key body.

11. The card key of claim 6, further comprising an accommodating recess formed in the card key support, the flat key body being removably accommodated within the accommodating recess when the base portion of the key body is not supported by the supporting member.

12. The card key of claim 6, wherein a longitudinal axis of the transmitter element is substantially parallel with a longitudinal axis of the flat key body when the base portion of the flat key body is supported by the supporting member.

13. The card key of claim 2, wherein the transmitter element includes a transmit-receive coil that generates the electromotive force.

14. The card key of claim 2, wherein the flat key body is a vehicle ignition key, and the transmitter element transmits an ID signal used to permit a vehicle to start or remain in operation when the lock insertion portion of the key body is inserted into a vehicle ignition slot.

15. The card key of claim 2, further comprising a cover extending over the holding recess to cover the transmitter element in the holding recess.

16. The card key of claim 15, wherein a portion of the cover extends into the holding recess.

17. The card key of claim 3, wherein the transmitter element includes a transmit-receive coil that generates the electromotive force.

18. The card key of claim 3, wherein the flat key body is a vehicle ignition key, and the transmitter element transmits an ID signal used to permit a vehicle to start or remain in operation when the lock insertion portion of the key body is inserted into a vehicle ignition slot.

19. The card key of claim 3, wherein the supporting member is a recess in the card key support.

20. The card key of claim 19, wherein the recess is located at a corner of the card key support.

21. The card key of claim 3, wherein the supporting member includes a holding member that engages a corresponding holding member of the flat key body.

22. The card key of claim 3, wherein a longitudinal axis of the transmitter element is substantial parallel with a longitudinal axis of the flat key body when the base portion of the flat key body is supported by the supporting member.

23. The card key of claim 3, further comprising a cover extending over the holding recess to cover the transmitter element in the holding recess.

24. The card key of claim 23, wherein a portion of the cover extends into the holding recess.

* * * * *